United States Patent [19]

Lee

[11] 4,042,147

[45] Aug. 16, 1977

[54] TISSUE PAPER TAKE-OUT DEVICE

[76] Inventor: Young Yee Lee, 156-37, Nockbun-dong, Soudaemun, Seoul, South Korea

[21] Appl. No.: 727,749

[22] Filed: Sept. 29, 1976

Related U.S. Application Data

[63] Continuation-in-part of Ser. No. 559,207, March 17, 1975, abandoned.

[51] Int. Cl.[2] ..... B65H 5/00

[52] U.S. Cl. ..... 221/225; 221/232; 221/278

[58] Field of Search ..... 221/209, 225, 231, 232, 221/37, 278

[56] References Cited

U.S. PATENT DOCUMENTS

| | | | |
|---|---|---|---|
| 1,106,559 | 8/1914 | Hamilton | 221/209 X |
| 1,486,079 | 3/1924 | Fernandez | 221/231 X |
| 1,553,954 | 9/1925 | Parsons | 221/209 X |
| 3,208,634 | 9/1965 | Saxe | 221/232 X |
| 3,208,635 | 9/1965 | Saxe | 221/232 X |

*Primary Examiner*—Allen N. Knowles
*Attorney, Agent, or Firm*—Sughrue, Rothwell, Mion, Zinn and Macpeak

[57] ABSTRACT

There is disclosed a device for taking tissue papers out of a container conveniently and hygienically as needed, by manual operation of a push plate mounted on the device, which actuates an air chamber to blow air onto the tissue and a roll which bears against the tissue surface for drawing out the tissue paper.

3 Claims, 4 Drawing Figures

TISSUE PAPER TAKE-OUT DEVICE

Cross-Reference to Related Application

This application is a continuation-in-part of application Ser. No. 559,207, filed Mar. 17, 1975, and abandoned upon the filing of this application.

BACKGROUND OF THE INVENTION

1. Field of Invention

The present invention relates to a tissue paper take-out device which is adapted to draw out tissue papers one by one, conveniently and sanitarily, by mechanical operation, while keeping the position and height of the stack of tissue papers in the tissue paper case properly adjusted, whereby the work of taking out is accomplished exactly and positively.

2. Description of the Prior Art

As known prior art, the paper boxes or containers filled with separated sheets of tissue papers in the form of a stack or a roll of tissue paper are used generally as articles at a dinner table, the table of a reception room, a toilet, and so forth. Accordingly, when one is in need of tissue papers and wants to take a sheet of tissue paper out from the roll of tissue papers or the paper box, one is required to tear the tissue paper off from the roll or pick up the one from the paper box manually. Such a handling of tissue papers is very unsanitary, and, moreover, as the action of tearing-off or picking-up takes time, the user feels uneasy and is annoyed.

OBJECTS OF THE INVENTION

The present invention obviates the disadvantages of the above-mentioned prior art devices and is intended to provide a device for drawing out tissue paper conveniently and sanitarily.

A more specific object of the invention is to provide a device smooth and exact in operation to take tissue paper out one by one.

A still more specific object of the invention is to provide a device for controlling the position and height of the stack of tissue papers continuously and properly in the case by mechanical means, thus accomplishing the operation of taking-out positively and exactly.

Other objects will be apparent from the description to follow and from the appended claim.

SUMMARY OF THE INVENTION

The tissue paper take-out device of the present invention comprises an upper and outer case having an inner case therein which includes a deformable air chamber, a push plate having a circular shape which is mounted on the upper and outer case to move up and down, movable rolls for pushing out the tissue papers one by one from the device by the movement of the push plate, and a lower and outer case having an installation case therein, which is formed to cooperate with the equipment of the said inner case and contains the stack of tissue papers.

Further, the present invention is characterized by means making the taking-out of tissue paper fast and positive by performing the pushing-out of the tissue by said rolls and simultaneously blowing-out of the tissue by the air pressure from the air chamber, and by means for maintaining the level of tissue paper stack aligned with the tissue paper outlet, the operation of which is accomplished by a pawl type actuater which is operated by the push plate.

DESCRIPTION OF THE PREFERRED EMBODIMENTS

Figure 1:
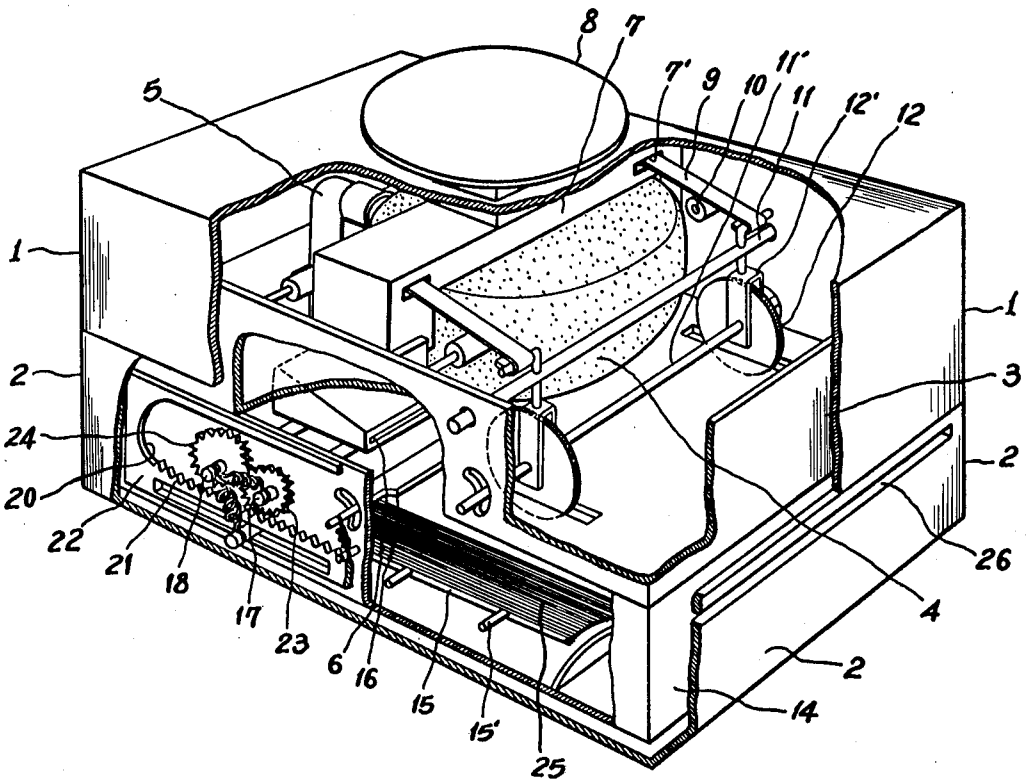
FIG. 1 is a front perspective view, partially broken away, of a first embodiment of a tissue paper take-out device embodying the present invention.
Figure 2:
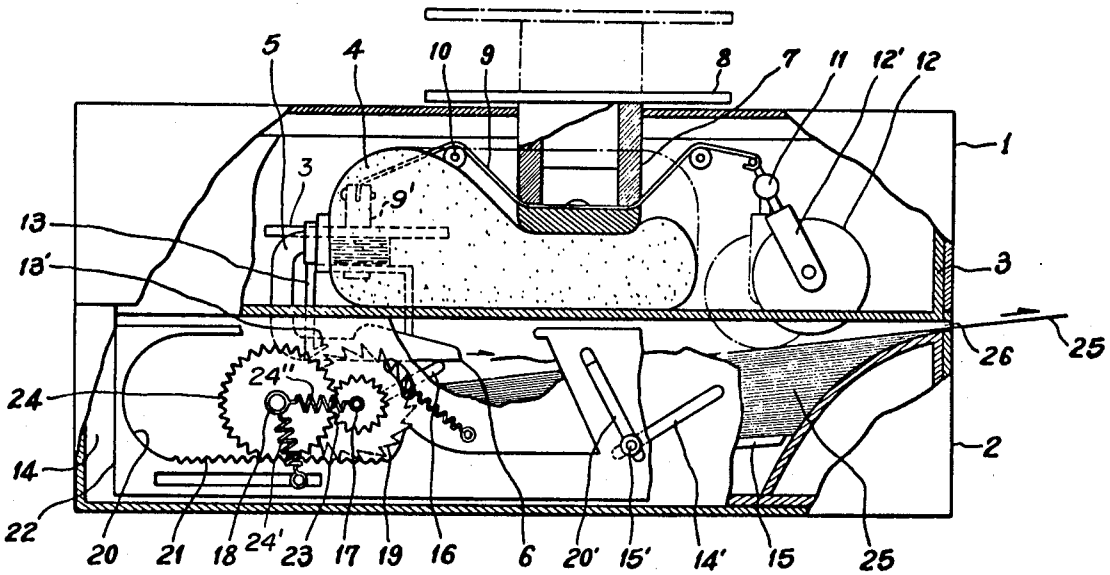
FIG. 2 is a side view, partially broken away, of the tissue paper take-out device of FIG. 1 in its operating mode when the push plate is pressed down.
Figure 3:
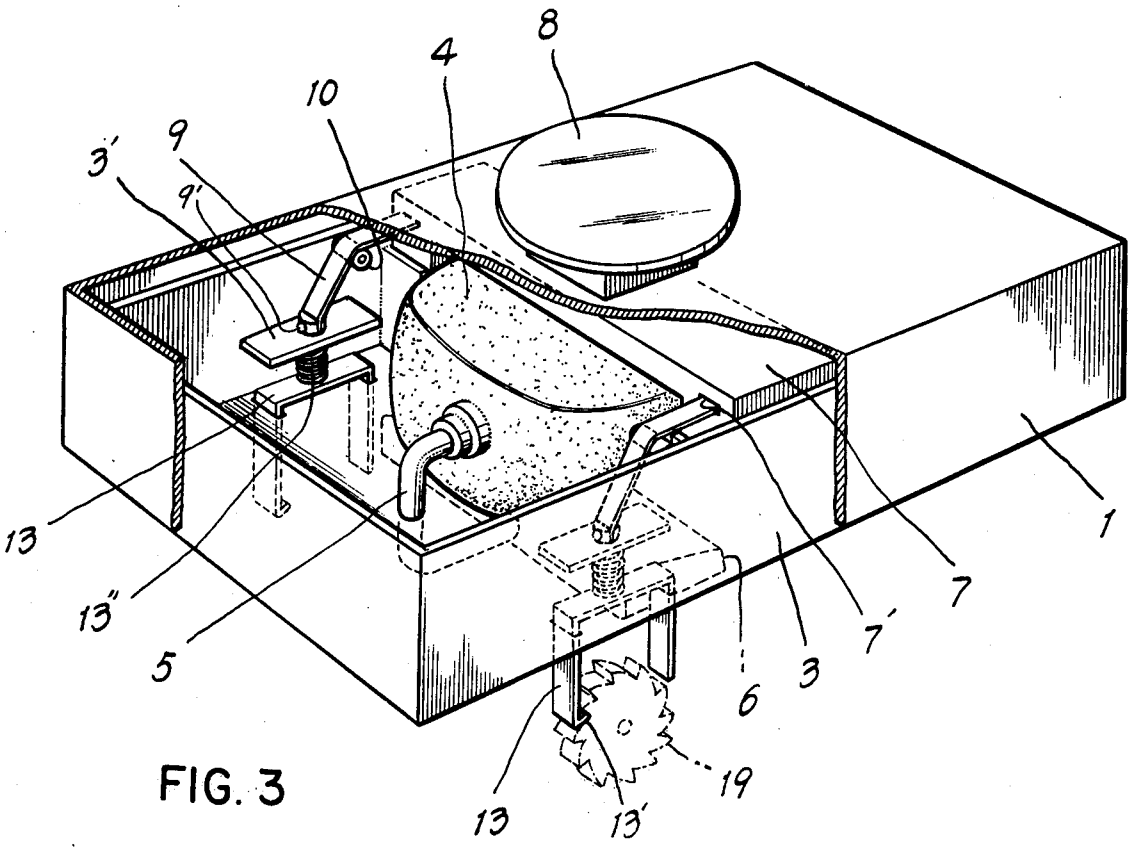
FIG. 3 is a rear perspective view, partially broken away, of the tissue paper take-out device of FIG. 1.

Referring to FIGS. 1–3 of the drawings, there is shown a tissue paper take-out device embodying the present invention. In referring to the figures, like numerals shall refer to like parts.

The embodiment of the invention described referring now to FIGS. 1–3 of the drawings comprises two parts, an upper case 1 and lower case 2.

The upper case 1 contains an inner case 3 which includes a deformable air chamber 4 of a great contractibility. Connected to the said air chamber 4 is a flexible tube 5, which is attached to an air spout 6 at its front end and which protrudes from the bottom surface of the inner case 3. Engaging the upper part of air chamber 4, a pressing arm 7 with holes 7' established at its two ends is movably mounted within the inner case 3. A push plate 8 having circular shape is attached to the processing arm 7 through the top surface of upper case 1. It goes without saying that the shape of push plate 8 may not be circular, but it can can be any shape according to the user's taste. Through the holes 7' of pressing arm 7, flexible strips 9, such as a thin steel band, are located so as to reciprocate with the pressing arm 7 and are sustained in the front and rear by the supporting rolls 10. The front ends of flexible strips 9 are attached to the bracket arms 12' which support rolls 12 and cross shafts 11, 11'. The rolls 12 are exposed partly below the bottom surface of the inner case 3. The rear ends of flexible strips 9 are attached to the top of pins 9'. The pins 9' are slidably mounted in holes in plates 3', jutting from the insides of the inner case 3, and the bottoms of the pins 9' are attached to the top of ⅄-shaped actuators 13 via springs 13''. The lower rear legs of the actuators 13 are formed into pawls 13' which extend below the bottom surface of the inner case 3 and interact with ratchets 19 as shown in FIG. 3.

Next, in the lower case 2, the installation case 14 is provided. At both sides of the said case 14, inclined internal slots 14' are established with the slope increasing toward the right, as shown in FIG. 2. Shafts 15', attached to and projecting from both sides of rising and falling plate 15, are inserted in the slots 14'. At the back side of the plate 15, a slant backing plate 16, and two cross shafts 17, 18 are provided. A ratchet 19 is attached to the shaft 17 and meshes with the pawl 13' of the actuater 13 so as to rotate in only one direction. The inclined external slots 20' are established in moving plates 22 which extend along both sides of the said case 14. The slots 20' extend in reverse direction from the inclined internal slots 14', namely, with the slope increasing toward the left as viewed in FIG. 2. The moving plates 22, which advance mechanically as a stack of tissue papers is dispensed by the device and which is reset manually when a new stack of tissue paper is inserted in the device, have a half-circle shaped opening 20 at one end and a rack 21 at part of its bottom surface. The moving plates 22 are installed so that the shafts 15', projecting from the both sides of the rising and falling plate 15, may be inserted into the inclined external slots 20'.

A large gear 24 is provided on the cross shaft 18, and it meshes with the rack 21. A small gear 23 is provided on the cross shaft 17, and also meshes with large gear 24. The large gear 24 is biased towards engagement with the rack 21 by a spring 24' connected to the end of a rod 21' slidably mounted in the moving plates 22 and towards engagement with the small gear 23 by a spring 24''. When the moving plates 22 are advanced by the rotation of the large gear 24, the rising and falling plate 15 together with the shafts 15' will rise up, to maintain the top surface of tissue paper 25 piled on the said plate 15 at the same level with the outlet 26 for taking out of tissue papers, thereby insuring that the taking-out operation of tissue paper may be accomplished exactly and smoothly.

After all the tissue paper has been taken out, the shaft 18 is slots 14'' is pushed up by hand or a suitable lever (not shown) in order to separate the gear 24 from the rack 21. The plate 15 is then pushed down, causing the moving plates 22 to move back to their original position since the shaft 15' is inserted into the slots 14' and 20' and at the same time causing the gear 24 to remesh with the rack 21 and the gear 23 due to the action of the springs 24' and 24''.

Next, referring specifically to FIG. 2, there is illustrated the operation of the aforementioned device.

When one presses down on push plate 8 to squeeze the air chamber 4, the air confined in the said air chamber 4 is forced through the flexible tube 5 and out the air spout 6, while at the same time the flexible strips 9 are pressed downward, thereby moving forward the rolls 12. Next, according to the downward movement of the strips 9, the actuater 13 connected to the rear end of the flexible strips 9 goes up and the pawl 13' formed at its end also rises, rotating the ratchet 19 by one pitch. As a result of the above mentioned operation, the uppermost of the tissue papers 25 piled on the rising and falling plate 15 is pushed out by the foreward movement of said roll 12 acting on the front side, while the tissue papers restrained slightly by the said slant backing plate 16 are blowed forward by the air pressure caused by the air chamber 4 to assist the aforesaid action of pushing-out by the rolls 12. Accordingly, as the tissue papers are pushed out at the both sides of the front and the rear cooperatively, the work of taking-out is achieved easily and positively.

Meanwhile, when the moving plate 22 is advanced forward by correlation with the actuater 13, the small gear 23, the long gear 24, and the rack 21, the rising and falling plate 15 rises upward by the height of tissue paper removed, since the shafts 15' of the said plate 15 are inserted into the two inclined slots 14', 20' simultaneously. Therefore, it is understood that, under the above mentioned structure, all the works including the taking-out of tissue paper and the level maintaining of tissue paper with the outlet 26, are accomplished automatically with ease due only to the pressing down of the push plate 8. It is further understood that since the operation is achieved mechanically, the swiftness and sanitation on the taking-out of tissue paper are kept effective.

Figure 4:
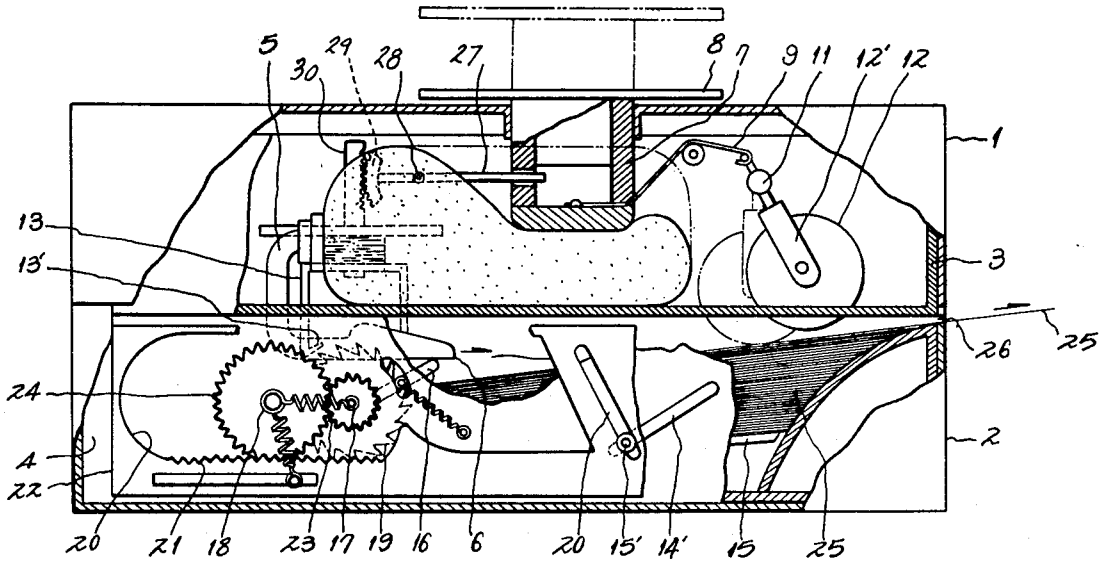
FIG. 4 is a side view, partially broken away, of a second embodiment of the tissue paper take-out device embodying the present invention.

FIG. 4 is a rear perspective view of portions of another embodiment of the present invention. For the most part, it is the same as the embodiment shown in FIGS. 1–3, and the same numbers are used to identify the same parts. In this embodiment, however, levers 27 pivoted at 28 and carrying sectional spur gears 29 which intermesh with vertical racks 30 carried by the actuators 13 replace the rear part of the flexible strips 9. The function of the levers 27 and the sectional spur gears 29 is, however, obviously identical to the function of the rear part of the flexible strips 9 - that is, they function to raise the actuators 13 and the pawls 13', thereby actuating the ratchet 19.

What is claimed is:

1. Apparatus for removing the uppermost tissue from a stack of tissues comprising:

a. an upper and lower case forming a housing having an outlet slot for the tissues;

b. a movable support plate supported within said lower case upon which the tissues are atacked;

c. a deformable air chamber located in said upper case;

d. manually operable deforming means extending through said upper case for deforming said deformable air chamber;

e. nozzle means connected to said deformable air chamber and extending into said lower case adjacent said stack of tissues so as to direct air expelled from said air chamber upon its deformation onto the uppermost tissue of said stack;

f. pushing means bearing against the exposed surface of the uppermost tissue of said stack and movable with respect to said upper case so as to push said uppermost tissue toward said outlet slot;

g. connecting means connecting said pushing means to said manually operable deforming means such that said pushing means pushes said uppermost tissue toward said outlet slot when said deforming means deforms said air chamber; and h. height adjusting means to adjust the height of said movable support plate so as to maintain the uppermost tissue of said stack in alignment with said outlet slot.

2. The apparatus of claim 1 wherein the connecting means comprises at least one flexible strip attached to said pushing means and said deforming means.

3. The apparatus of claim 1 wherein said height adjusting means comprises:

a. an installation case having side walls located within said lower case, said installation case having at least one inclined slot through each side wall;

b. a movable pawl extending into said lower case;

c. means connecting said pawl to said deforming means such that said pawl moves upwardly as said deforming means deforms said air chamber;

d. a first shaft rotatably mounted within said lower case;

e. a ratchet wheel attached to said first shaft and engaging said movable pawl so as to rotate said first shaft during upward movement of said pawl;

f. at least one first gear mounted on said first shaft so as to rotate therewith;

g. a second shaft rotatably mounted within said lower case parallel to said first shaft, h. at least one second gear attached to said second shaft in meshing engagement with said at least one first gear;

i. at least one moving plate slidably attached to the sidewall of said installation case, said moving plate having a rack formed thereon and engaging said at least one second gear so as to slide relative to said installation case sidewall when said at least one second gear rotates, and having at least one inclined slot therethrough;

j. at least one shaft attached to said movable support plate and extending through the inclined slot in said installation case side-wall and the inclined slot in said moving plate such that relative movement between the moving plate and the installation case changes the height of said movable support plate.

* * * * *